United States Patent [19]

Rodarte

[11] 4,279,103

[45] Jul. 21, 1981

[54] HAND TOOL FOR USE IN SANDING LOUVER BOARDS

[76] Inventor: Jesse Rodarte, 410 N. Eighth, Fowler, Calif. 93625

[21] Appl. No.: 101,096

[22] Filed: Dec. 7, 1979

Related U.S. Application Data

[63] Continuation-in-part of Ser. No. 903,703, Dec. 11, 1978, abandoned.

[51] Int. Cl.[3] ..... B24D 15/04

[52] U.S. Cl. ..... 51/389; 51/390; 51/391; 15/210 A

[58] Field of Search ..... 51/363, 389, 391, 392, 51/393, 358, 390; 15/210 A, 224, 394, 210 R

[56] References Cited

U.S. PATENT DOCUMENTS

| | | | |
|---|---|---|---|
| 103,717 | 5/1870 | Chapman | 51/390 |
| 1,062,214 | 5/1913 | Bergman | 51/363 |
| 1,145,134 | 7/1915 | Fowler | 51/392 |
| 1,455,559 | 5/1923 | Wright et al. | 51/391 |
| 1,562,415 | 11/1925 | Newman | 51/392 |
| 1,570,177 | 1/1926 | Pointer | 51/363 |
| 2,036,107 | 3/1936 | Thomas | 51/391 |
| 2,400,928 | 5/1946 | Hein | 51/391 |
| 3,975,868 | 8/1976 | Botimer | 51/358 |

FOREIGN PATENT DOCUMENTS

| | | | |
|---|---|---|---|
| 1402358 | 8/1975 | United Kingdom | 15/210 A |

*Primary Examiner*—Harold D. Whitehead
*Assistant Examiner*—K. Bradford Adolphson
*Attorney, Agent, or Firm*—Huebner & Worrel

[57] ABSTRACT

A block-like body including a cap plate and a pair of rigid plates of a common width and of different lengths substantially registered with said cap plate and disposed in mutually superimposed relation for defining a pair of adjacently related working surfaces arranged in mutually stepped alignment, and a sanding pad arranged in substantially covering relation with each of the working surfaces, each pad being characterized by a resiliently backed, rigidly supported strip of abrasively coated, flexible material having at least one end secured between a pair of said plates and a screw extended through said plates for releasably securing the plates against displacement relative to one another.

1 Claim, 3 Drawing Figures

HAND TOOL FOR USE IN SANDING LOUVER BOARDS

CROSS-REFERENCE TO RELATED APPLICATION

This application is a continuation-in-part application of application Ser. No. 903,703, filed Dec. 11, 1978 now abandoned.

BACKGROUND OF THE INVENTION

The invention generally relates to hand-tools for use in performing sanding operations, and more particularly to an improved tool particularly suited for use in simultaneously performing sanding operations on commonly facing surfaces of a pair of closely spaced louver boards, or the like.

DESCRIPTION OF THE PRIOR ART

The prior art is, of course, replete with disclosures of sanding blocks, rubbing blocks, and the like, adapted to receive sheets of abrasive material, such as sandpaper and the like, and so shaped and sized as to accommodate manipulation thereof. For example, see U.S. Letters Pat. No. 1,145,134, which issued July 6, 1915, to L. H. Fowler.

However, as should readily be apparent to all those who have attempted to employ conventional sanding blocks in the sanding of various surfaces, herein simply referred to as sand finishing operations, such blocks do not readily lend themselves to the sand finishing of louver boards and, consequently, a substantial amount of time is required in finishing louver doors, shutters, etc.

It is, of course, well recognized that manual sanding operations require the application of substantial amounts of pressure to the working surface of sandpaper, emery cloth, and the like, in order for the abrasive surface thereof to be effective in removing old paint, varnish, or in reducing irregularities in the surface of the material being treated. Consequently, it is also well recognized that a sanding block adapted to be manipulated for purposes of performing sand finishing operations must be of a rather rigid construction in order to facilitate the required application of pressure to the abrasive surface. It is also well recognized that a use of a resilient backing for the sandpaper, emery cloth, or the like, is preferable in most instances, in order to enhance the effectiveness and longevity of the abrasive material being employed. Finally, the tool must be adapted to receive new and discharge spent sheets of the material being employed.

It is therefore the general purpose of the instant invention to provide improved hand tools which facilitate a rapid sand finishing of louver boards and the like.

OBJECTS AND SUMMARY OF THE INVENTION

It is an object of the instant invention to provide a hand-tool for use in sand finishing louver boards.

It is another object to provide in a hand tool particularly suited for use in simultaneously sand finishing commonly facing surfaces of a pair of closely spaced slats, such as louver boards, or the like, an improved block-like body characterized by stepped working surfaces adapted to engage multiple surfaces of the slats of said pair.

It is another object to provide a hand-tool with a block-like configuration having particular utility in the painting industry and adapted to be employed in simultaneously sand finishing commonly facing surfaces of a multiplicity of louver boards, although not restricted in use thereto, since the invention has utility in other operations, such as rubbing and the like.

These together with other objects and advantages are achieved through the use of a block-like body including a pair of rigid plates of a common width and different lengths arranged in superimposed relation defining a pair of adjacently related working surfaces arranged in mutually stepped alignment, and a sanding pad arranged in substantially covering relationship with each of the working surfaces, said pad being characterized by a resiliently backed, rigidly supported strip of abrasively coated flexible material, as will become more readily apparent by reference to the following description in the claims in light of the accompanying drawings.

DESCRIPTION OF THE PREFERRED EMBODIMENT

Figure 1:
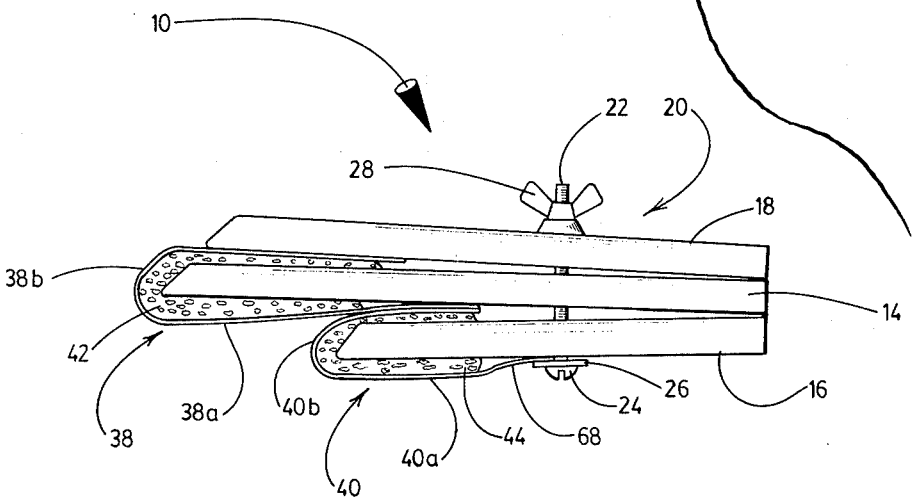
FIG. 1 is a side elevational view of a hand-tool embodying the principles of the instant invention.

Referring now to the drawings, with more particularity, wherein like reference characters designate like or corresponding parts throughout the several views, there is shown in FIG. 1 a hand tool, generally designated 10, embodying the principles of the instant invention.

Figure 3:
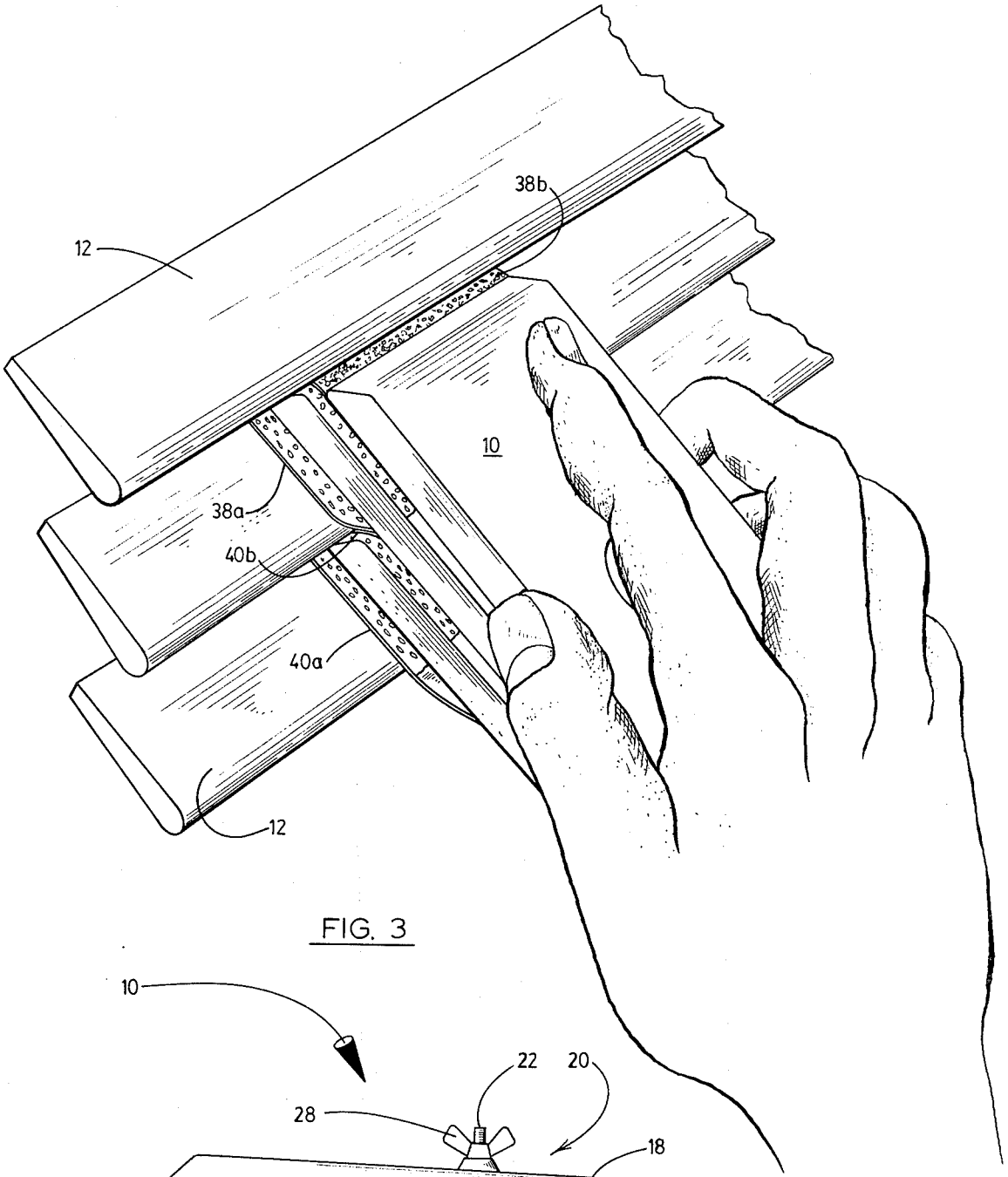
FIG. 3 is a perspective pictorial view depicting the tool shown in FIG. 1 as it is employed in a sand finishing operation.

As shown, the tool 10 is particularly suited for use in simultaneously sand finishing commonly facing surfaces of a pair of closely spaced louver boards, or the like, designated 12, FIG. 3, and includes a first pad-supporting plate and a second pad-supporting plate, designated 14 and 16, respectively. Additionally, the tool 10 includes a cap plate 18 similar in shape and size to the plates 14 and 16, but differing substantially in function. The plates 14, 16 and 18 are of a substantially planar configuration, as well as a substantially common width and thickness, but are of substantially differing lengths, the purpose for which will hereinafter become more readily apparent.

As shown, the plates 14, 16 and 18 are united to form a body, generally designated 20, having a block-like shape. In practice, the plates 14, 16 and 18 are secured together to form the body 20, through the use of a screw 22 having a head 24 supported by a washer 26. Additionally, a wing-nut 28 is threadably received by the screw, at the end thereof opposite the head 24, with a suitable washer 30 interposed between the wing-nut and the surface of the cap plate 18.

Figure 2:
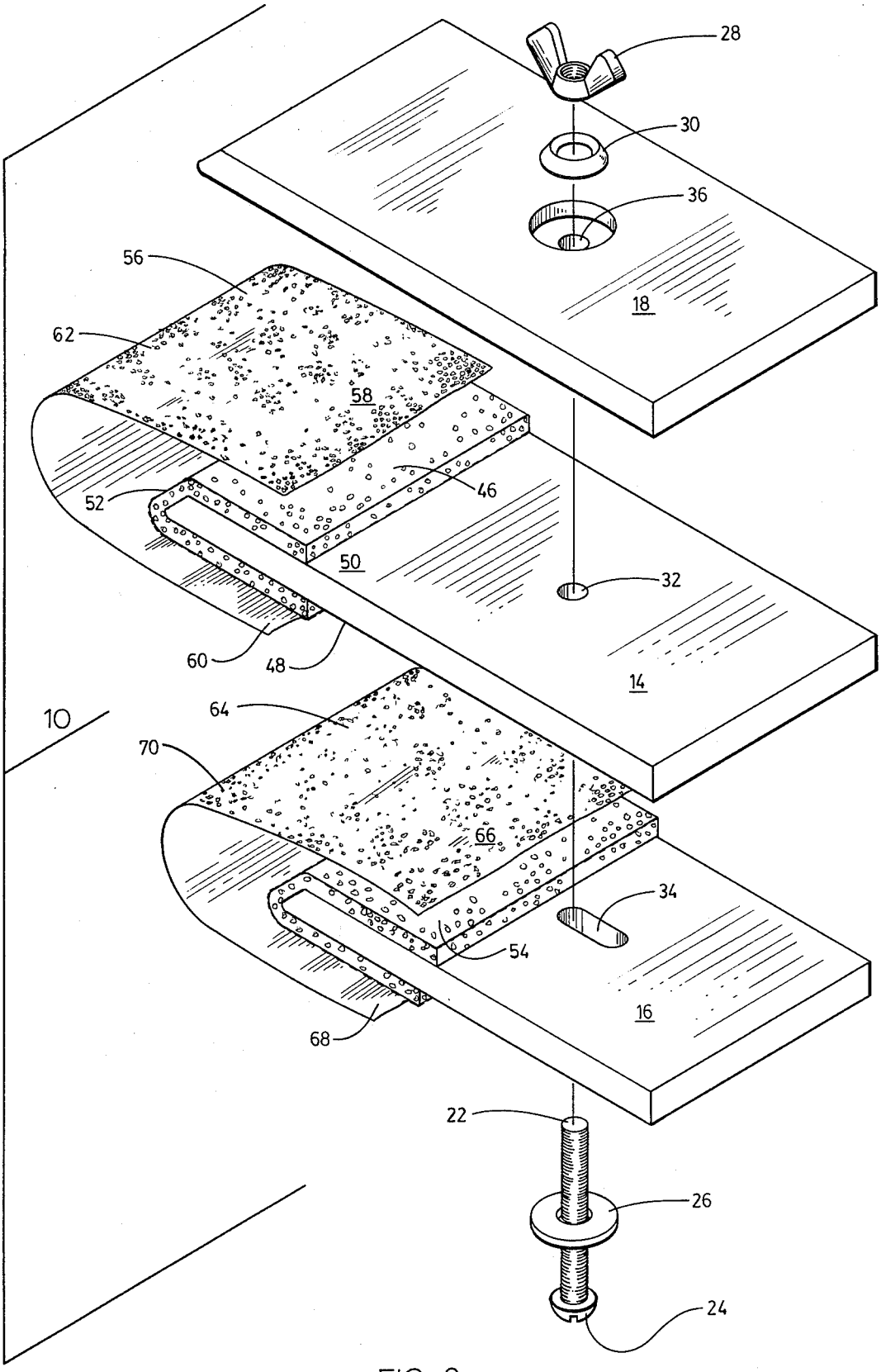
FIG. 2 is a perspective exploded view of the tool shown in FIG. 1.

In practice, the plates 14, 16 and 18 include apertures 32, 34 and 36, respectively, which when coaxially aligned, collectively define a bore for receiving the screw 22. At this juncture, it is also noted that the aperture 34 is shaped to form an elongated slot particularly adapted for accommodating displacement of the plate 16 in axial directions, relative to the body 20. As should readily be apparent from a cursory review of FIG. 2, the plates 14, 16, and 18 readily may be disassociated, each from the other, simply by removing the screw 22.

The plate 14 includes a first working surface, generally designated 38, while the plate 16 includes a second working surface, generally designated 40. The surfaces 38 and 40 are arranged in mutually stepped, commonly facing directions. It is noted that the working surface 38 includes a major segment 38*a* and a minor segment 38*b*, while the working surface 40 includes a major segment 40*a* and a minor segment 40*b*.

The working surfaces 38 and 40 are, in practice, established by sanding pads 42 and 44 affixed to the plates 14 and 16, respectively. Referring again to FIG. 2, it is noted that each of the pads comprise a backing strip covered by a strip of abrasive material. For example, the pad 42 includes a strip of a resilient material, such as a layer of sponge rubber, or the like, encircling the end portion of the plate 14, and thus is positioned at opposite side surfaces of the plate, designated 48 and 50, as well as the end surface of the plate 14, not designated.

A backing strip 54, similar to the backing strip 46, is positioned about the end of the plate 16. Since the backing strip 54 is similar in design and function to the backing strip 46, a detailed description of the backing strip 54 is omitted. As a practical matter however, it is to be understood that the backing strips 46 and 54 are secured to the surfaces of the plates 14 and 16 employing a suitable adhesive.

Disposed in covering relationship with the backing strip 46 there is an abrasive strip 56, formed of a suitable abrasive material. The abrasive strip 56 preferably comprises a strip of flexible material having a single abrasive surface, and is typified by materials such as sandpaper, emery cloth, and the like. It is important to note that the strip 56 includes a head segment 58, a tail segment 60 and a working segment extended between the head and tail segments. The purpose of the head and tail segments is to facilitate the securing of the strip 56 to the tool 10, in a manner hereinbefore more fully described.

Similarly, a second abrasive strip 64 is wrapped about the backing strip 54, in covering relationship therewith, and includes a head segment 66 and a tail segment 68, with a working segment 70 extended between the head and tail segments thereof.

Like the head and tail segments 58 and 60, of the strip 56, the head and tail segments 66 and 68 facilitate a securing of the strip 64 to the tool 10, as also will hereinafter become readily apparent.

In order to assemble the tool 10 to the configuration illustrated in FIG. 1, a first abrasive strip 56 is wrapped about the backing strip 46, while a second abrasive strip 64 is wrapped about the backing strip 54. The screw 22 next is inserted upwardly through the aperture 34, of the plate 16, the aperture 32 of the plate 14, and the aperture 36 of the plate 18, with the washer 26 being interposed between the head 24 of the screw and the adjacent surface of the plate 16. Of course, it is necessary for the adjacent surface of the capping plate 18 to engage the head segment 58 of the abrasive strip 56 for purposes of "clamping" the segment 58 between the adjacent surfaces of the plates 14 and 18. The tail segment 60 of the strip 62 is, as well as the head segment 66 of the strip 64, interposed between the adjacent surfaces of the plates 14 and 16 for effecting a "clamping" of these segments between the adjacent surfaces of the plates 14 and 16. Finally, as best shown in FIG. 1, the tail segment 68 of the strip 64 is received beneath the washer 26 so that the end of this segment is, in effect, clamped between the adjacent surfaces of the washer 26 and the plate 16. Thus the device is assembled preparatory to use.

In order to employ the device, in the manner depicted in FIG. 3, the surface segment 38*a* is seated on a planar surface of one of the louver boards 12 while the surface segment 40*a* is seated on an adjacent planar surface of an adjacent louver board 12. Additionally, it is important to note that the segment 38*b* of the surface 38 and the segment 40*b* of the surface 40 are disposed in abutting relation with the arcuate edge surfaces of the louver boards 12. Consequently, the surface segment 38*a* engages a flat side surface of one of the louver boards 12 while the contiguous surface segment 38*b* engages an edge surface of an adjacent louver board. Similarly, the surface segment 40*a* engages the side surface of a louver board 12, while the contiguous segment 40*b* engages the end surface of the same louver board engaged by the surface segment 38*a*. Hence, it should be apparent that the four segments 38*a*, 38*b*, and 40*a* and 40*b* simultaneously engage four surfaces, whereby a simultaneous sand finishing of the surfaces is facilitated.

In view of the foregoing, it should be apparent that the hand-tool embodying the principles of the instant invention provides a practical solution to many of the problems heretofore plaguing those engaged in the sand finishing of louver doors, shutters, and the like.

Although the invention has been herein shown and described in what is conceived to be the most practical and preferred embodiment, it is recognized that departures may be made therefrom, within the scope of the invention, which is not to be limited to the illustrative details disclosed.

Having described my invention, what I claim as new and desire to secure by Letters Patent is:

1. A hand-tool of a block-like configuration having utility in the painting industry and adapted to be employed in simultaneously sand finishing commonly facing surfaces of a pair of louver boards comprising:

A. an elongated body including a pair of pad-supporting plates, each being of an elongated, planar shape, the plates of said pair being characterized by a common width and different lengths, and disposed in superimposed relation with adjacent ends of the plates at one end of the body being arranged in substantial co-planar alignment and the opposite ends thereof being provided with segmented working surfaces, each including a first side surface and an end surface, said working surface of said pair of plates being arranged in a mutually staggered relationship;

B. means defining a pair of sanding pads for said working surfaces including a pair of backing strips formed of a resilient backing material and adhesively affixed to said working surfaces in a substantially covering relationship with the first side surfaces, the end surfaces and second side surfaces opposite the first side surfaces thereof, and a pair of flexible sanding strips formed of a flexible material, each sand strip being characterized by a head and a tail segment, and an abrasive working surface extended between the segments suitable for use in sand finishing operations, said sanding strips being disposed in overlapped relationships with said backing strips, said head and tail segments being extended beyond each of the opposite ends of the backing strips;

C. means for securing to said body said sanding strips including a rigid cap plate disposed on one pad-supporting plate, in superimposed relation with an adjacent surface thereof, opposite to said working surface, for clamping therebetween the head segment of said one of the sanding strips, and tail segment engaging surfaces defined on adjacently disposed surfaces of the pad-supporting plates of said pair for clamping therebetween the tail segment of one and the head segment of the other of the sanding strips of said pair;

D. means for securing said plates against displacement relative to one another including a bore projected through the plates perpendicularly to the planes thereof, a screw extended through said bore, and a nut mounted on said screw; and E. means for securing the tail segment of the other strip of said pair, including a washer mounted on said screw and seated on the tail segment of the other sanding strip of the pair.

* * * * *

UNITED STATES PATENT AND TRADEMARK OFFICE

CERTIFICATE OF CORRECTION

PATENT NO. : 4,279,103

DATED : July 21, 1981

INVENTOR(S) : Jesse Rodarte

It is certified that error appears in the above-identified patent and that said Letters Patent are hereby corrected as shown below:

Column 1, line 8, delete "903,703" and substitute ---903,707---.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*